US009127878B2

(12) United States Patent
Gossens et al.

(10) Patent No.: US 9,127,878 B2
(45) Date of Patent: Sep. 8, 2015

(54) TILT-OUT BIN AND REMOVABLE CRISPER

(75) Inventors: Caleb Gossens, Charlotte, NC (US); Nicolas Saeger, Pewaukee, WI (US)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 6 days.

(21) Appl. No.: 13/982,383

(22) PCT Filed: Jan. 31, 2012

(86) PCT No.: PCT/US2012/023290
§ 371 (c)(1),
(2), (4) Date: Sep. 30, 2013

(87) PCT Pub. No.: WO2012/106316
PCT Pub. Date: Aug. 9, 2012

(65) Prior Publication Data

US 2014/0312758 A1 Oct. 23, 2014

Related U.S. Application Data

(60) Provisional application No. 61/437,995, filed on Jan. 31, 2011.

(51) Int. Cl.
*F25D 23/04* (2006.01)
*F25D 25/02* (2006.01)

(52) U.S. Cl.
CPC ..... *F25D 25/025* (2013.01); *F25D 23/04* (2013.01)

(58) Field of Classification Search
CPC ... F25D 23/04; F25D 17/062; F25D 2400/04; A47B 46/00; A47B 96/005
USPC ..... 312/404, 405, 405.1, 321.5
See application file for complete search history.

(56) References Cited

U.S. PATENT DOCUMENTS

| | | | | |
|---|---|---|---|---|
| 2,894,378 | A | 7/1957 | Saunders et al. | |
| 2,898,173 | A * | 8/1959 | Squire | 312/248 |
| 4,186,978 | A * | 2/1980 | Thomson | 312/321.5 |
| 4,333,588 | A * | 6/1982 | Schreck et al. | 222/164 |
| 5,193,892 | A * | 3/1993 | Swindell | 312/405.1 |
| 5,370,453 | A * | 12/1994 | Wolff | 312/217 |

(Continued)

FOREIGN PATENT DOCUMENTS

| | | |
|---|---|---|
| EP | 0779484 | 6/1997 |
| EP | 1724539 | 11/2006 |

(Continued)

OTHER PUBLICATIONS

International Search Report for PCT/US2012/023290, dated Dec. 21, 2012, 3 pages.

*Primary Examiner* — Daniel Rohrhoff
(74) *Attorney, Agent, or Firm* — Pearne & Gordon LLP

(57) ABSTRACT

A storage structure (20) is provided for mounting within a refrigerator compartment (12). The storage structure (20) includes a slide unit (30) attached within the refrigerator compartment (12). The slide unit (30) is removably attached within the refrigerator compartment (12) and includes one or more projections (46) extending outwardly from the slide unit (30) for engaging receiving structures (18) within the refrigerator compartment (12). The storage structure (20) further includes at least one bin (22) removably attached to the slide unit (30), the at least one bin (22) includes an engagement structure that movably attaches the bin (22) to the slide unit (30).

19 Claims, 8 Drawing Sheets

(56) References Cited

U.S. PATENT DOCUMENTS

| | | | | |
|---|---|---|---|---|
| 5,445,452 | A * | 8/1995 | Kauffman et al. | 312/405.1 |
| 5,765,390 | A * | 6/1998 | Johnson et al. | 62/441 |
| 6,742,855 | B2 * | 6/2004 | Whitaker et al. | 312/405.1 |
| 6,805,183 | B2 * | 10/2004 | Goodwin et al. | 156/577 |
| 7,070,249 | B2 * | 7/2006 | Leimkuehler et al. | 312/405.1 |
| 7,111,914 | B2 * | 9/2006 | Avendano | 312/405.1 |
| 7,350,886 | B2 * | 4/2008 | Antos et al. | 312/404 |
| 7,552,983 | B2 * | 6/2009 | Shin | 312/405.1 |
| 7,775,613 | B2 * | 8/2010 | Williams | 312/321.5 |
| 7,832,227 | B2 * | 11/2010 | Wu et al. | 62/344 |
| 8,322,804 | B2 * | 12/2012 | Kim | 312/405.1 |
| 8,833,882 | B2 * | 9/2014 | Seo et al. | 312/405.1 |
| 8,864,252 | B1 * | 10/2014 | Rodriguez Cobas et al. | 312/405.1 |
| 2002/0117947 | A1 * | 8/2002 | Cheng | 312/327 |
| 2003/0102787 | A1 * | 6/2003 | Whitaker et al. | 312/405.1 |
| 2004/0012314 | A1 * | 1/2004 | Hay et al. | 312/405.1 |
| 2006/0061247 | A1 * | 3/2006 | Lee et al. | 312/404 |
| 2006/0250063 | A1 * | 11/2006 | Czach et al. | 312/405.1 |
| 2007/0228904 | A1 * | 10/2007 | Williams | 312/327 |
| 2010/0270902 | A1 * | 10/2010 | Kim et al. | 312/405.1 |

FOREIGN PATENT DOCUMENTS

| | | |
|---|---|---|
| JP | 5240573 | 9/1993 |
| JP | 2009222343 | 10/2009 |
| WO | 0214761 | 2/2002 |

* cited by examiner

TILT-OUT BIN AND REMOVABLE CRISPER

CROSS-REFERENCE TO RELATED APPLICATIONS

This application claims priority to U.S. provisional patent application No. 61/437,995, filed on Jan. 31, 2011, the disclosure of which is expressly incorporated herein by reference for all purposes in its entirety.

BACKGROUND OF THE INVENTION

1. Field of the Invention

The present invention relates generally to refrigerators, and, more particularly, to refrigerators with a removable bin.

2. Description of Related Art

Traditional refrigerators have been designed with a variety of shelves and bins to store food products. For example, it is known to provide shelves and bins within the refrigerator with additional shelves and bins on doors of the refrigerator. Food items may need to be easily accessed and cleaned. Therefore, it would be beneficial to provide a removable bin within the refrigerator. Further, it would be beneficial to provide the bin with one or more openings that allow water or liquid to drain from the bin.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a refrigerator is provided including a refrigerator compartment and a storage structure positioned within the refrigerator compartment. The storage structure includes a slide unit attached within the refrigerator compartment, and at least one bin removably attached to the slide unit, the at least one bin movable between an opened position and a closed position.

In accordance with another aspect, a refrigerator is including a refrigerator compartment and a storage structure positioned within the refrigerator compartment. The storage structure includes a slide unit removably attached within the refrigerator compartment, the slide unit including one or more projections extending outwardly from the slide unit for engaging receiving structures within the refrigerator compartment, and at least one bin removably attached to the slide unit, the at least one bin including an engagement structure configured to movably attach the bin to the slide unit.

In accordance with another aspect, a storage structure for mounting within a refrigerator is provided. The storage structure includes a slide unit attached within the refrigerator, the slide unit including one or more guiding structures projecting outwardly from a wall of the slide unit, and at least one bin movably mounted to the slide unit, the at least one bin including engagement structures configured to engage the guiding structures, wherein the engagement structures are configured to move with respect to the guiding structures, further wherein the at least one bin is removable from the slide unit.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION OF THE INVENTION

Figure 1:
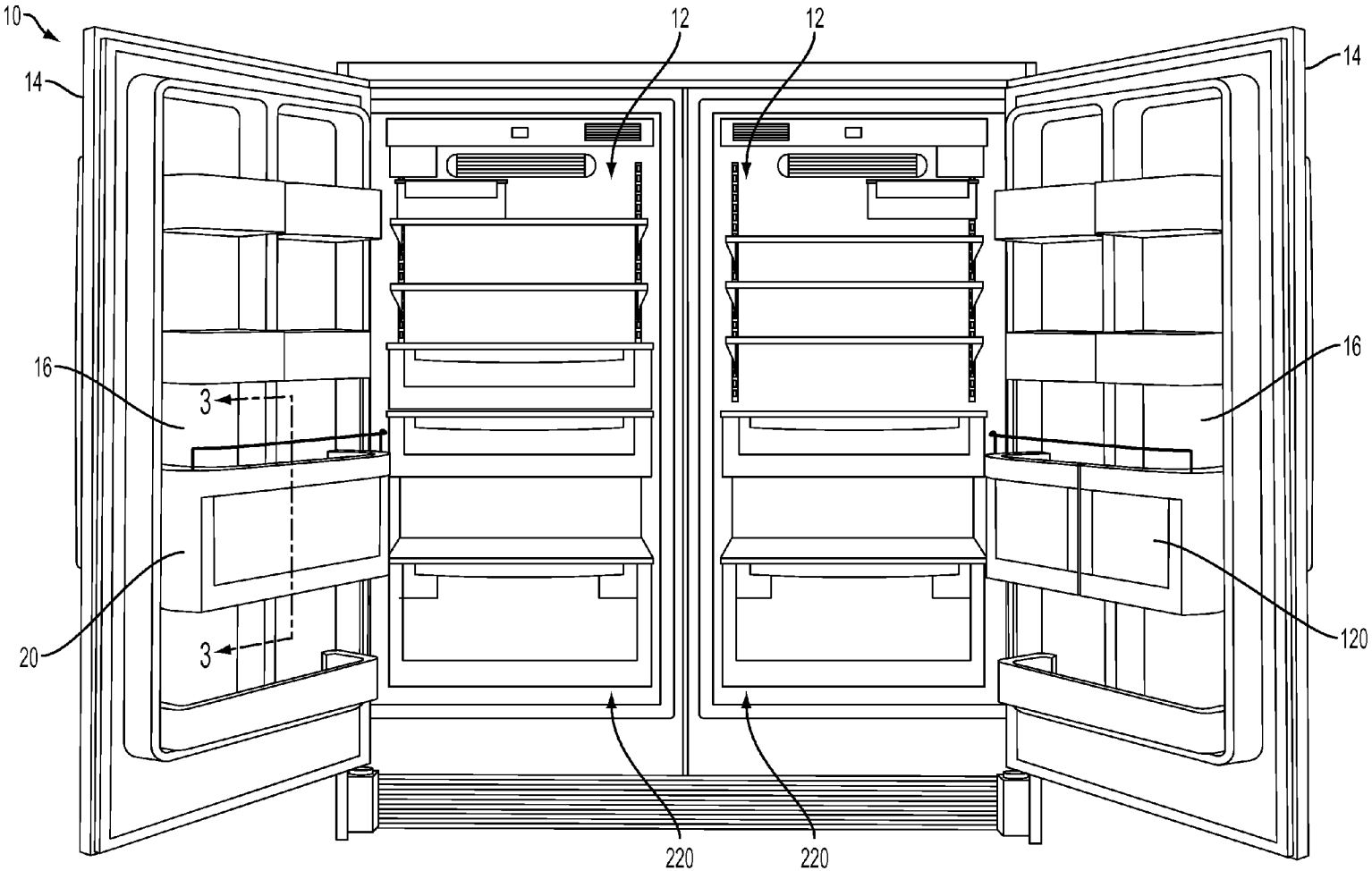
FIG. 1 is a perspective view of a refrigerator including a pair of doors with an example storage structure positioned on each door.

Example embodiments that incorporate one or more aspects are described and illustrated in the drawings. These illustrated examples are not intended to be a limitation on the present examples. For example, one or more aspects can be utilized in other embodiments and even other types of devices. Moreover, certain terminology is used herein for convenience only and is not to be taken as a limitation on the present examples. Still further, in the drawings, the same reference numerals can be employed for designating the same elements.

Referring to the shown example of FIG. 1, a refrigerator 10 is shown. The refrigerator 10 may include two cabinets, with each cabinet including an interior compartment 12. The refrigerator 10 can include one or more doors 14 that provide access to the interior compartment 12. While not shown in the example, the refrigerator 10 can also include a cooling system with a compressor, heat-exchange pipes, an expansion valve, refrigerant, etc. in order to cool the refrigerator compartments.

While FIG. 1 illustrates a double compartment refrigerator, the refrigerator 10 can also include a single compartment or more than two compartments. Moreover, if provided with multiple compartments, one or more compartments may by located above the other, such as with a French door bottom mount freezer, and/or laterally with respect to one another. Still further, one compartment may be located partially or entirely within another compartment. In one example, the refrigerator 10 can include a side by side refrigerator. As another example, a two compartment refrigerator can be configured such that either one or both compartments may be maintained at a temperature above or below freezing providing for two freezers, two refrigerators, or one freezer and one refrigerator. For instance, a lower compartment may be kept at a temperature below freezing, such that the lower compartment is functionally a freezer compartment, while the upper compartment can be kept at a temperature above freezing.

The refrigerator 10 can include doors 14 that can cover a front of the interior compartment 12. The doors 14 can each include a handle, or the like, to allow a user to open and close the doors 14. The doors 14 can each include an interior portion 16 facing the interior compartment 12 of the refrigerator 10. The interior portion 16 can take the form of a refrigerator liner, and can include a variety of storage structures, such as shelves, drawers, or the like that can be removably or fixedly attached to the interior portion 16. As will be described in more detail below, each of the interior portions 16 can include a storage structure 20, 120 that is removably attached to the interior portion 16.

Figure 2:
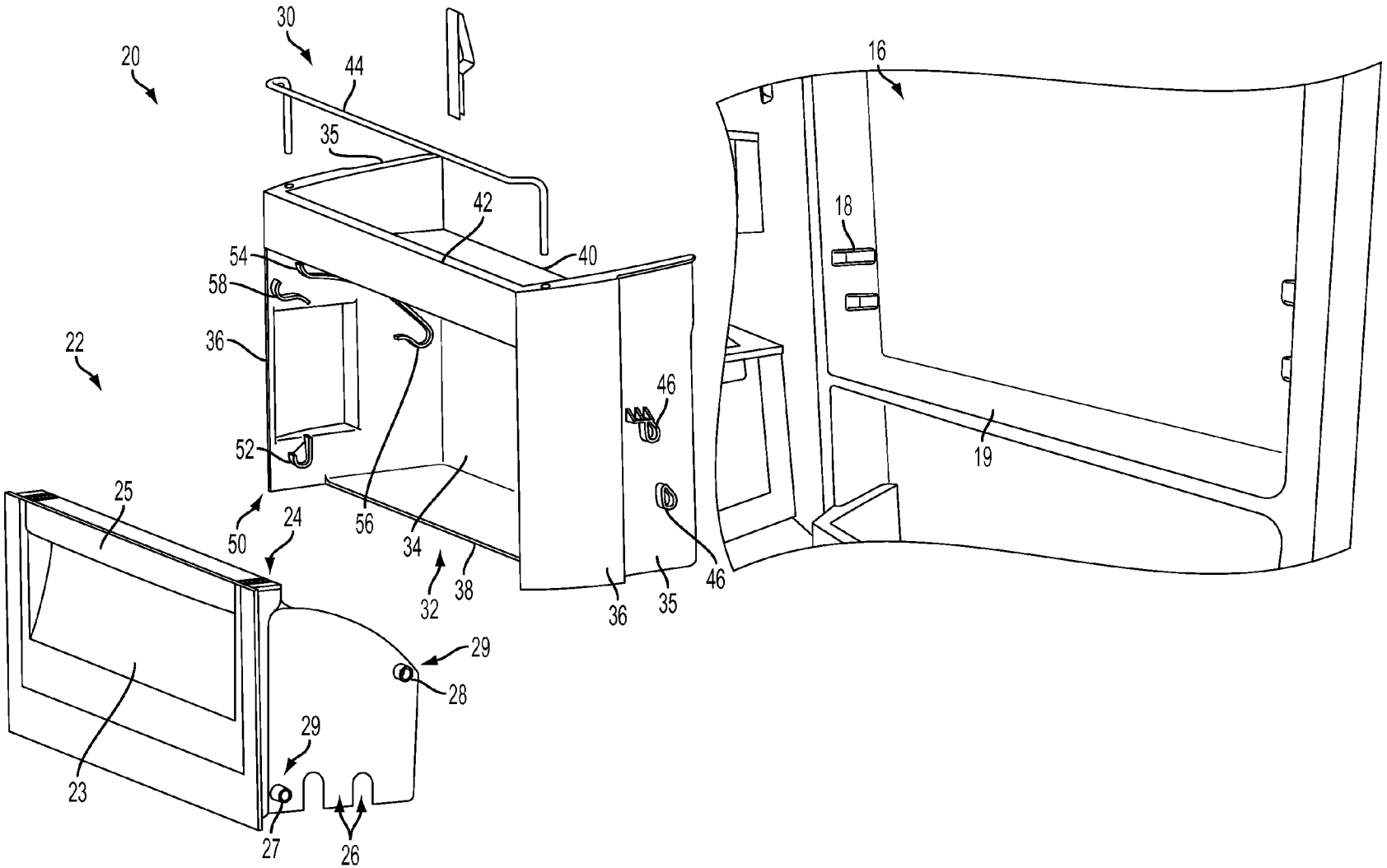
FIG. 2 is an exploded view of a first example storage structure.

Referring now to FIG. 2, there is shown an exploded view of the storage structure 20. The storage structure 20 can be positioned in a number of different structures, including refrigerators. Specifically, the storage structure 20 could be positioned in a freezer compartment of the refrigerator or a fresh food compartment of the refrigerator. The storage structure 20 can be positioned in a number of locations. For instance, the storage structure 20 could be positioned on a door of the fresh food compartment, on a wall of the fresh food compartment, or anywhere within the interior compartment 12 of the fresh food compartment. Similarly, the storage structure 20 could be positioned on a door of the freezer compartment, on a wall within the freezer compartment, or within an inner compartment of the freezer compartment. It is to be understood that the storage structure 20 can be provided in a variety of refrigerators. For instance, the storage structure 20 could be provided in a French door style refrigerator with the freezer compartment at the bottom of the refrigerator and the fresh food compartment at the top of the refrigerator. Similarly, the storage structure 20 could be provided in a side by side style refrigerator, a top refrigerator/bottom freezer style, etc.

The storage structure 20 can include a bin 22 and a slide unit 30. The bin 22 can be a bucket shaped structure that is sized to receive and hold objects, including fruits, vegetables, yogurt, and the like. The bin 22 can be bounded by four vertical walls and a horizontal bottom wall. Together, the walls can further define an interior portion of the bin 22. Further, the four vertical walls and the horizontal bottom wall can define an opening 24 at a top portion of the bin 22, such that objects can be inserted into the interior portion of the bin 22 through the opening 24. The opening 24 can be completely open or can be partially open. In further examples, a top wall could be provided at the opening 24, such that the top of the bin 22 is substantially closed. The top wall could be removably attached to the bin 22, such that a user can access the objects in the interior portion of the bin 22.

The four vertical walls can include a front wall, a rear wall, and two opposing side walls connecting the front wall to the rear wall. The bin 22 can include a window 23 positioned at the front wall. The window 23 can allow a user to view objects in the interior portion of the bin 22. It is to be understood, however, that any or all of the vertical walls and horizontal bottom wall could be transparent or include a window, such that the user can view objects in the interior portion through any of the walls. The front wall can further include a handle 25, allowing a user to grasp the handle 25 to open and close the bin 22. The handle 25 can be positioned at an upper portion of the front wall, and can either be formed integrally as part of the front wall, or can be a separate piece that is attached to the front wall. The handle 25 includes a downwardly extending front portion that a user can grasp.

The bottom wall and/or side walls can include a variety of structures to allow for water or liquid to drain from the bin 22. For instance, the bottom wall can include one or more openings 26, apertures, holes, etc. The openings 26 could be positioned at a plurality of locations within the bin 22, such as along the edges of the bottom wall, towards the center of the bottom wall, etc. Similarly, in one example, the bottom wall could be formed from a plurality of rods, or the like, extending between the vertical side walls across the bottom of the bin 22. It is to be understood, however, that any number of structures can be included to allow water or liquid to drain from the bin 22. In addition, one or more of the vertical side walls could include openings, apertures, holes, etc. such that water or liquid could drain from the bottom wall and/or the one or more vertical side walls.

The four vertical walls can include two opposing side walls. Each of the two opposing side walls can include one or more engagement structures 29. For instance, as shown, the engagement structures 29 can be positioned on each of the opposing side walls and can include a pivoting member 27 and a pin 28. The pivoting member 27 and the pin 28 can be rounded, substantially circular projections, though other shapes and sizes are contemplated. The pivoting member 27 and the pin 28 can be integrally formed as part of the opposing side walls, or can be attached separately to the opposing side walls, such as by attaching a projection with an adhesive, screw, snap fit means, etc. Each pivoting member 27 can be positioned at a lower front portion of the opposing side wall adjacent to the front wall. Each pin 28 can be positioned at an upper rear portion of the opposing side wall adjacent to the rear wall. The pivoting member 27 and the pin 28 could, however, be positioned at varying positions on each opposing side wall depending on the application, and are not limited to the locations shown and described herein.

The slide unit 30 of the storage structure 20 can now be discussed. As stated above, the storage structure 20, and, therefore, the slide unit 30, can be mounted to the refrigerator 10 at a variety of locations. The slide unit 30 can include an inner portion 32 defined by a rear wall 34, two opposing side walls 36, a bottom wall 38, and a top wall 40. The inner portion 32 can include an opening at a front portion.

The top wall 40 can form a ledge allowing for items, including pop, juice, jars, etc. to be placed on the top wall 40. The slide unit 30 can further include a front wall 42 projecting upwardly from the top wall 40. By projecting upwardly from the top wall 40, the front wall 42 does not block the opening at the front portion of the slide unit 30. The front wall 42 can define a front barrier such that items will not fall from the ledge. The two opposing side walls 36 can also project upwardly. As such, the two opposing side walls 36, together with the front wall, can define a barrier that surrounds the ledge. In addition, a railing 44 can be included. While the railing 44 is shown to project upwardly from the front wall 42, it is to be understood that the railing 44 could also project upwardly from the opposing side walls 36 as well. The railing 44 can be attached to a top portion of either the front wall 42 or the opposing side walls 36, such as by being removably inserted into one or more holes. The railing 44 can further be attached to the slide unit 30 with a clip.

The slide unit 30 can be mounted within the refrigerator 10 in a number of ways. For instance, in the shown example, the opposing side walls 36 can include projections 46 that extend outwardly from the opposing side walls 36. The shown example includes two projections on each of the opposing side walls 36, however, more than two or fewer than two can be included. The projections 46 can be positioned at a variety of locations along the opposing side walls 36. In the shown example, the projections 46 include an upper forward projection and a lower rear projection. The projections 46 can engage one or more corresponding receiving structures 18 in the refrigerator 10.

In the shown example of FIG. 2, the receiving structures 18 can be positioned on the interior portion 16 of the door 14. However, it is to be appreciated that the receiving structures 18 could be placed in a variety of locations such that the slide unit 30 can be mounted at a number of locations within the refrigerator 10. Similarly, the receiving structures 18 could include a variety of structures, such as hooks, protrusions, or the like.

In operation, each of a lower and upper projection 46 on each of the opposing side walls 36 can engage a lower and upper receiving structure 18, respectively, on opposing sides of the interior portion 16. Specifically, the projections 46 can rest behind the receiving structure 18 such that the receiving structure 18 can hold the projections 46, and, therefore, the slide unit 30, in place. In one example, the slide unit 30 can be lowered from above the receiving structures 18 such that the projections 46 in the slide unit 30 can slide behind the receiving structures 18, thus holding the slide unit 30 in place.

The opposing side walls 36 can further include a recessed portion 35. The recessed portion 35 can project inwardly from the opposing side walls 36. A width between the opposing recessed portions 35 can be sized to be substantially equal to a width that extends between the receiving structures 18. Accordingly, the projections 46 can be tightly held by the receiving structure 18, such that the slide unit 30 is secured to the interior portion 16 with limited movement.

To provide further support, the interior portion 16 can include a ledge 19. The ledge 19 can extend outwardly from the interior portion 16 towards the interior compartment 12 of the refrigerator 10. The ledge 19 can form a bottom shelf, or the like, to support the slide unit 30 when the slide unit 30 is held in place by the receiving structures 18. As such, the ledge 19 forms a lower limit support structure for the slide unit 30 and can assist in preventing the slide unit 30 from sliding downwardly with respect to the interior portion 16. The slide unit 30 can readily be removed, such as by lifting the slide unit 30 so that the projections 46 are no longer held in place by the receiving structures 18. As such, the slide unit 30 can be readily attached and held in place by both the receiving structures 18 and the ledge 19, and can be readily detached to be removed from the interior portion 16.

The inner portion 32 of the slide unit 30 can now be described. The inner portion 32 can be defined by the rear wall 34, two opposing side walls 36, the bottom wall 38, and the top wall 40. The inner portion 32 includes an opening positioned at the front of the slide unit 30. As such, the inner portion 32 can be sized to receive other structures therein.

Guiding structures 50 can be positioned on interior sides of the opposing side walls 36. While the guiding structures 50 are shown on one of the opposing side walls 36, it is to be understood that the guiding structures 50 are also provided on the other opposing side wall 36. In the shown examples, the guiding structures 50 can include a reception area 52 and a track 54. The reception area 52 can be positioned at a lower front portion of the opposing side walls 36. The reception area 52 can project inwardly from the inner sides of the opposing side walls 36. The reception area 52 can include a rounded, U-shaped area, configured to receive and releasably hold the pivoting members 27 of the bin 22. Though the reception area 52 is shown to be U-shaped in the figures, it could take on a number of shapes as well, such as V-shaped, J-shaped, etc.

The guiding structures 50 further include the track 54. The track 54 can be positioned along an upper portion of the opposing side walls 36. The track 54 can extend from a rear upper portion of the opposing side walls 36 to a front upper portion of the opposing side walls 36. The track 54 can also project inwardly from the inner sides of the opposing side walls 36. The track 54 can include a rounded guide with a stop structure, such as a first stop 56. The first stop 56 can define a substantially rounded, U-shaped portion of the track 54, such that the pins 28 of the bin 22 can be releasably held. The first stop 56 can prevent the pins 28 from being inadvertently removed from the track 54, and can indicate to a user that the pins 28 have reached their rearmost position.

The guiding structures 50 can further include a stop structure, such as a second stop 58. The second stop 58 can define a second, separate track from the track 54. The second stop 58 can be positioned at an upper front corner of the opposing side walls 36. The second stop 58 can be positioned slightly below the track 54 at a location that is closer to the front of the slide unit 30 than the track 54. The second stop 58 can be a U-shaped structure that allows the pins 28 of the bin 22 to engage the second stop. The pins 28 can rest on the second stop and be held in the U-shape such that the bin 22 can rest in a pulled out position. It is to be appreciated, however, that the second stop 58 need not be limited to a U-shaped structure. Rather, the second stop 58 can include any number of rounded, curved, bent structures, or the like. For example, the second stop 58 can comprise a J-shaped structure, V-shaped structure, etc. As such, the second stop 58 shown in FIG. 2 comprises merely one possible example of a second stop, as a number of different structures are envisioned.

Figure 3:
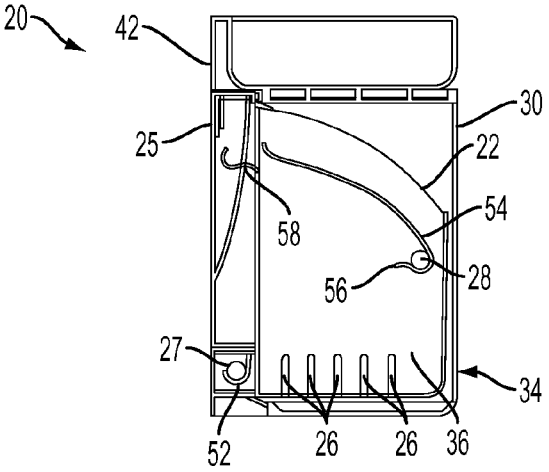
FIG. 3 is a cross-sectional view of the first example storage structure including a bin in a closed position taken along line 3-3 of FIG. 1.

Referring now to FIG. 3, a cross-sectional view of the storage structure 20 is shown along line 3-3 of FIG. 1. The bin 22 can initially be placed in a first position (see FIG. 3), in which the bin 22 can be fully inserted into the slide unit 30 in a closed position.

To position the bin 22 in the slide unit 30, the pivoting member 27 of the bin 22 can first be inserted into the reception area 52 of the slide unit 30. The pivoting member 27 can be pivotally held in place by the reception area 52. The bin 22 can be inserted at an angle, thus aligning the pivoting members 27 with the reception areas 52. With the pivoting member 27 in place, the upper portion of the bin 22 can be pivoted towards the inner portion 32 of the slide unit 30. As the bin 22 is pivoted towards the inner portion 32, the pins 28 can first engage the second stop 58. The pins 28 can slide over the second stop 58 and then engage the track 54. The pins 28 can slide along the track 54 with the pins 28 being guided by and below the track 54. As the pins 28 are guided along the track 54, the bin 22 pivots towards the inner portion 32 of the slide unit 30. Finally, the pins 28 can reach the end of the track 54 whereupon the pins 28 pass over the first stop 56 and can be held in place by the first stop 56. Once in place, the bin 22 is in a closed position.

Figure 4:
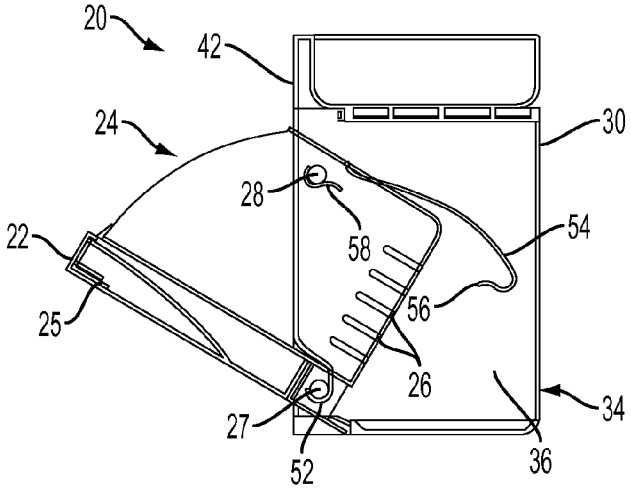
FIG. 4 is a cross-sectional view of the first example storage structure including the bin in an opened position taken along line 3-3 of FIG. 1.

Referring now to FIG. 4, a cross-sectional view of the storage structure 20 is shown with the bin 22 in an opened position. The opening of the bin 22 from the closed position (FIG. 3) to the opened position (FIG. 4) can now be described. To open the bin 22, a user can grasp the handle 25 and pull the bin 22 outwardly away from the inner portion 32 of the slide unit 30. As the user pulls the bin 22, the pivoting member 27 can remain in engagement and nested with the reception area 52. The pivoting member 27 can pivot while the pin 28 is guided from the first stop 56 and along the track 54. The pin 28 can pass along the track 54 until reaching the second stop 58. The pin 28 can be held by the second stop 58 with an engagement front portion of the second stop 58. The engagement front portion of the second stop 58 can hold the bin 22 in the opened positioned without a user having to grasp the handle. More specifically, the weight of the bin 22 can bias the bin 22 forward while the pin 28 can be held in place against the engagement front portion of the second stop 58. Accordingly, in the opened position of FIG. 4, the pivoting member 27 can be nested with the reception area 52 while the pin 28 remains in engagement and nested with the second stop 58. The opening 24 can project upwardly and outwardly away from the slide unit 30 such that a user can access the interior portion of the bin 22 as the bin 22 remains opened.

Figure 5:
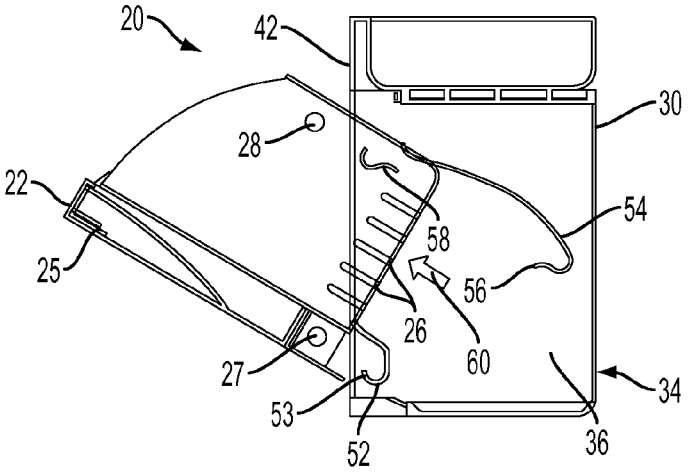
FIG. 5 is a cross-sectional view of the first example storage structure including the bin in an opened and removed position taken along line 3-3 of FIG. 1.

Referring now to FIG. 5, the bin 22 can be in a removed position with the bin 22 removed from the slide unit 30. The removal of the bin 22 from the opened position (FIG. 4) can now be described. In the opened position, the pivoting member 27 can be nested within the reception area 52 and the pin 28 can be nested with the second stop 58. The reception area 52 can include an engagement portion 53. The engagement portion 53 can be positioned at a front portion of the reception area 52. The engagement portion 53 can limit and/or prevent the pivoting member 27 from falling out of the reception area 52 in a forward direction. Similarly, the second stop 58 includes an engagement portion that holds the pin 28 and prevents the pin 28 from falling out in a forward direction. To remove the bin 22, the user can lift the bin 22 in an upward vertical direction. Each of the engagement portion 53 of the reception area 52 and the engagement portion of the second stop 58 can extend upwardly a predetermined distance, such as ½" (one half inch), ¾" (three quarters inch), 1" (one inch), etc. Once the bin 22 is lifted above the predetermined distance, the pivoting member 27 and the pin 28 will be above the engagement portions and will no longer be blocked in a forward direction. As such, the bin 22 can be pulled forward and outwardly by the user, in a forward direction 60 away from the slide unit 30. Once the bin 22 is pulled away, the user can run water or liquid over the contents of the bin 22, such as fruits and vegetables. The water or liquid can freely drain from the bottom wall of the bin 22 due to the openings 26. Once finished, the user can replace the bin 22 into the slide unit 30 in a similar manner as described above.

It is to be understood that the storage structure 20 can include a number of different examples that allow the bin 22 to pivot and be removed from the slide unit 30. As such, the bin 22 and the slide unit 30 are not limited to the shown examples. Rather, the guiding structures 50 comprise merely one possible example of a structure that can function to assist in guiding the bin 22. In further examples, the slide unit 30 may include variations of the guiding structures 50 and/or may not include the guiding structures 50.

In one example, the guiding structures 50 can include the track 54 positioned below the pin 28, such that the pin 28 rests on the track and is guided along the track 54. In another example, the first stop 56 and second stop 58 may not be included. Rather, the stop structures could include the bottom wall 38 and/or the rear wall 34. In such an example, the bin 22 could rest on the bottom wall 38 and/or the rear wall 34, such that the bottom wall 38 and/or the rear wall 34 function as a first stop and a second stop. Along these lines, the guiding structures 50 need not include the reception area 52, as the bin 22 can rest on the bottom wall 38 and/or rear wall 34. In yet another example, the guiding structures 50 may not include the track 54 and first stop 56, such that the guiding structures 50 include only the reception area 52. In such an example, the pivoting member 27 of the bin 22 can rest in the reception area 52 as the bin 22 rests upon the bottom wall 38 of the structure. The bin 22 could naturally pivot about the pivoting member 27 to be removed.

In another example, the guiding structure 50 can comprise an upwardly extending portion that protrudes upwardly from the bottom wall 38 towards the top wall. In this example, the bottom wall 38 can function as the stop structure while the upwardly extending portion can function as the guiding structure. The upwardly extending portion can engage and contact the front bottom portion of the bin 22, such that the bin 22 can pivot with respect to the upwardly extending portion.

Figure 6:
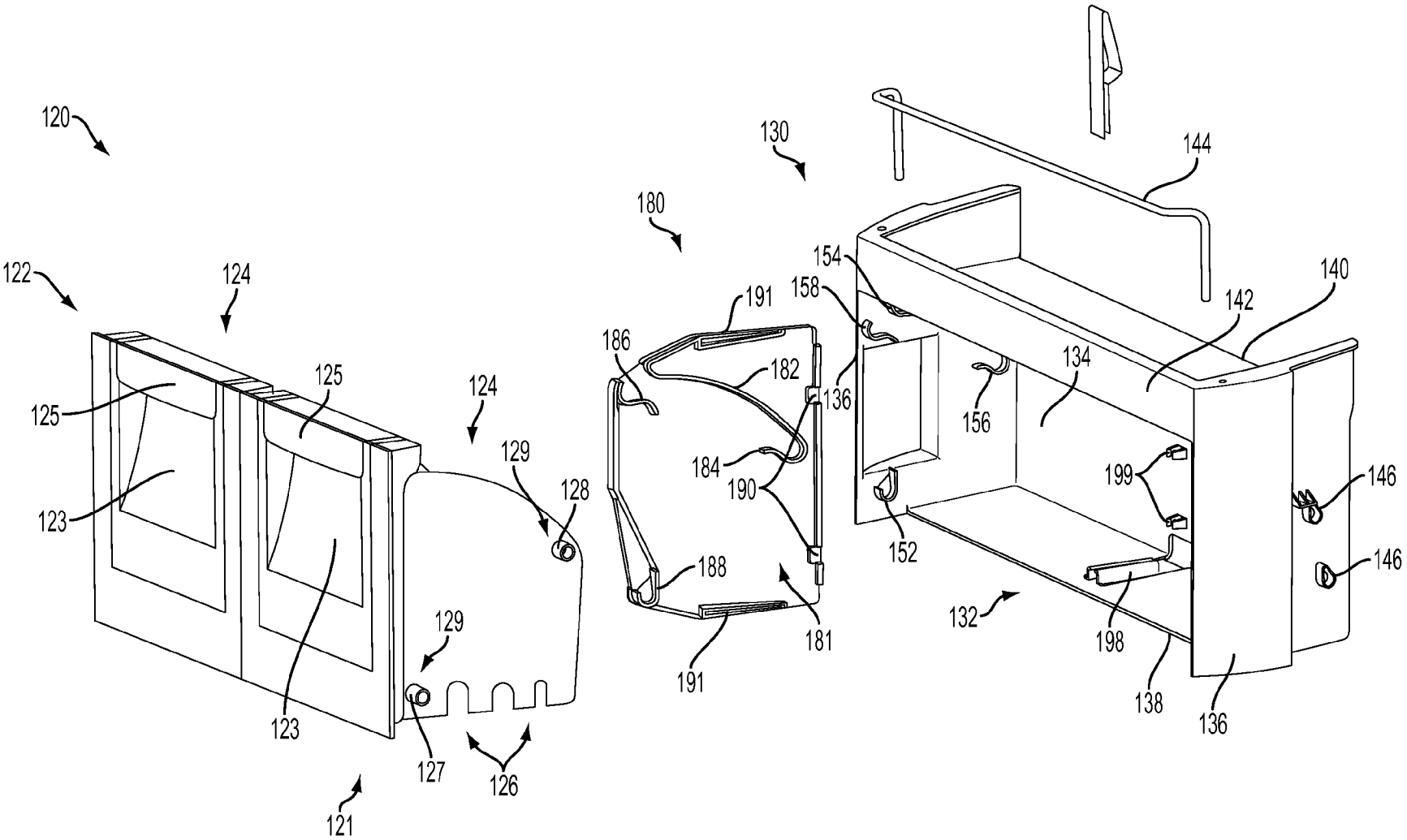
FIG. 6 is an exploded view of a second example storage structure.

Referring now to FIG. 6, a second example of the storage structure 120 is shown. The storage structure 120 can include a plurality of bins and, in the shown example, can include a first bin 121 and a second bin 122. The first bin 121 and the second bin 122 are substantially identical and can be positioned adjacent each other. The first bin 121 and second bin 122 can be substantially identical to the bin 22 shown in FIGS. 2-5. The first bin 121 and the second bin 122 can each be bucket shaped structures that are sized to receive and hold objects, including fruits, vegetables, and the like. The first bin 121 and the second bin 122 can each be bounded by four vertical walls and a horizontal bottom wall. Together, the walls can define interior portions of the first bin 121 and the second bin 122. Further, the four vertical walls and the horizontal bottom wall can define openings 124 at a top portion of each of the first bin 121 and the second bin 122. As such, objects can be inserted into each of the first bin 121 and the second bin 122 through the openings 124. As with the previous example, the top portions of the first bin 121 and the second bin 122 can be completely open, as shown in the drawings, or can be partially open. In further examples, a top wall could be provided at the top portion, such that the top of the first bin 121 and the second bin 122 can be substantially closed. The top wall could be removably attached to the first bin 121 and the second bin 122, such that a user can access the objects in the interior portion of the bins.

The first bin 121 and the second bin 122 can each include four vertical walls, a front wall, a rear wall, and two opposing side walls connecting the front wall to the rear wall. The first bin 121 and the second bin 122 can each include a window 123 positioned at the front wall. The window 123 can allow a user to view objects in the interior portion of the bins. It is to be understood, however, that any or all of the vertical walls and horizontal bottom wall could be transparent or include a window, such that the user can view objects in the interior portion through any of the walls. The front wall of each of the first bin 121 and the second bin 122 can further include a handle 125, allowing a user to grasp the handle 25 to open and close the second bin 122. The handle 125 can be positioned at an upper portion of the front wall, and can either be formed integrally as part of the front wall, or can be a separate piece that is attached to the front wall. The handle 25 includes a downwardly extending front portion that a user can grasp.

As with the previous example, the bottom wall and/or side walls of each of the first bin 121 and the second bin 122 can include a variety of structures to allow for water or liquid to drain from the first bin 121 and the second bin 122. For instance, the bottom wall can include one or more openings 126, apertures, holes, etc. The openings 126 could be positioned at a plurality of locations within the bins, such as along the edges of the bottom wall, towards the center of the bottom wall, etc. Similarly, in one example, the bottom wall could be formed from a plurality of rods extending between the vertical side walls across the bottom of the first bin 121 and the second bin 122. It is to be understood, however, that any number of structures can be included to allow water or liquid to drain from the first bin 121 and the second bin 122. In addition, one or more of the vertical side walls could include openings, apertures, holes, etc. such that water or liquid could drain from the bottom wall and/or the one or more vertical side walls.

Each of the first bin 121 and the second bin 122 can include engagement structures 129. The engagement structures can be positioned on opposing sides of each of the first bin 121 and the second bin 122. Specifically, the engagement structures can include a pivoting member 127 and a pin 128 positioned on the opposing sides. The pivoting member 127 and pin 128 can be similar and/or substantially identical to the pivoting member 27 and pin 28 described above with respect to the first example of the storage structure 20. The pivoting member 127 and the pin 128 can be integrally formed as part of the opposing side walls, or can be attached separately to the opposing side walls, such as by attaching a projection with an adhesive, screw, snap fit means, etc. Each pivoting member 127 can be positioned at a lower front portion of the opposing side wall adjacent to the front wall. Each pin 128 can be positioned at an upper rear portion of the opposing side wall adjacent to the rear wall. The pivoting member 127 and the pin 128 could, however, be positioned at varying positions on each opposing side wall depending on the application, and are not limited to the locations shown and described herein.

The storage structure 120 can include a divider 180 that assists in attaching the first bin 121 and the second bin 122 to a slide unit 130. As will be described below, the divider 180 can be removably inserted into the slide unit 130. The divider 180 can define a substantially planar structure with opposing sides. Each side of the divider 180 can include guiding structures 181. In the shown examples, the guiding structures 181 can include a reception area 188 and a track 182. The reception area 188 can be positioned at a lower front portion of each side of the divider 180. The reception area 188 can project outwardly from the surfaces of the divider 180. The reception area 188 can include a rounded, U-shaped area, configured to receive and releasably hold the pivoting members 127 of the first bin 121 and the second bin 122. Though the reception area 188 is shown to be U-shaped in FIG. 6, it could take on a number of shapes as well, such as V-shaped, J-shaped, etc.

The guiding structures 181 can further include the track 182 and a second stop 186. The track 182 can be provided at an upper portion of the divider 180, and can further include a first stop 184. The track 182 can extend from a rear upper portion of the divider 180 to a front upper portion of the divider 180. The track 182 can also project inwardly from the opposing sides of the divider 180. The track 182 can include a rounded guide with a first stop 184. The first stop 184 can define a substantially rounded, U-shaped portion of the track 182, such that the pins 128 of the first bin 121 and the second bin 122 can be releasably held. The first stop 184 can prevent the pins 128 from being inadvertently removed from the track 182, and can indicate to a user that the pins 128 have reached their rearmost position. The second stop 186 can include a second, separate track from the track 182. The second stop 186 can be positioned at an upper front corner of the divider 180. The second stop 186 can be positioned slightly below the track 182. The second stop 186 can be a U-shaped structure that allows the pins 128 of the first bin 121 and the second bin 122 to engage the second stop 186. The pins 128 can rest on the second stop 186 and be held in the U-shape such that the first bin 121 and the second bin 122 can rest in a pulled out position.

The divider 180 can further include attachment structures that assist in attaching the divider 180 to the slide unit 130. The divider 180 can further include detent portions 190 positioned at a rear portion of the divider 180. The detent portions 190 can define grooves, channels, or the like positioned at the rear portion of the divider 180. The divider can also include guiding projections 191 positioned at top and bottom walls of the divider. The guiding projections 191 extend outwardly from the divider 180 and define an elongated structure extending partially along the length of a bottom of the divider 180. The guiding projections 191 can be formed integrally with the divider 180, or can be added as a separate structure. As will be described in more detail below, the slide unit 130 can include corresponding structures that engage the detent portions 190 and the guiding projections 191 to hold the divider 180 in a fixed attachment with the slide unit 130.

The storage structure 120 can further include the slide unit 130. The slide unit 130 can be substantially identical to the slide unit 30 described in the previous example shown in FIG. 2. As with the previous example, the storage structure 120, and, therefore, the slide unit 130, can be mounted to the refrigerator 10 at a variety of locations. The slide unit 130 can include an inner portion 132, defined by a rear wall 134, and two opposing side walls 136. The inner portion 132 can further be defined by a bottom wall 138 and a top wall 140. The inner portion 132 can include an opening at a front portion.

The top wall 140 can form a ledge allowing for items, including pop, juice, jars, etc. to be placed on the top wall 140. The slide unit 130 can further include a front wall 142 projecting upwardly from the top wall 140. By projecting upwardly from the top wall 140, the front wall 142 does not block the opening at the front portion of the slide unit 130. The front wall 142 can define a front barrier such that items will not fall from the ledge. The two opposing side walls 136 can also project upwardly from the top wall 140. As such, the two opposing side walls 136, together with the front wall, can define a barrier that surrounds the ledge. In addition, a railing 144 can be included. While the railing 144 is shown to project upwardly from the front wall 142, it is to be understood that the railing 144 could also project upwardly from the opposing side walls 136 as well. The railing 144 can be attached to a top portion of either the front wall 142 or the opposing side walls 136, such as by being removably inserted into one or more holes. The railing 144 can further be attached to the slide unit 130 with a clip.

The slide unit 130 can be mounted within the refrigerator 10 in the same manner as described above with respect to FIG. 2. For instance, in the shown example, the opposing side walls 136 can include projections 146 that extend outwardly from the side walls 136. The shown example includes two projections on each side wall 136, however, more than two or fewer than two can be included. The projections 146 can be positioned at a variety of locations along the side walls 136. In the shown example, the projections 146 include an upper forward projection and a lower rear projection. The projections 146 can engage the corresponding receiving structures 18 (shown in FIG. 2) in the refrigerator 10.

The inner portion 132 of the slide unit 130 can now be described. As stated above, the inner portion 32 can be defined by a rear wall 134, two opposing side walls 136, a bottom wall 138, and the top wall 140. The inner portion 132 includes an opening positioned at the front of the slide unit 130. Interior sides of the opposing side walls 136 can include guiding structures 150 for the first bin 121 and the second bin 122. The guiding structures 150 can be identical in size, shape, and location to the guiding structures 50 shown in the first example (FIG. 2). In the shown examples, the guiding structures 150 can include a reception area 152 and a track 154. The reception area 152 can be positioned at a lower front portion of the opposing side walls 136. The reception area 152 can project inwardly from the inner sides of the opposing side walls 136. The reception area 152 can include a rounded, U-shaped area, configured to receive and releasably hold the pivoting members 127 of the first bin 121 and the second bin 122. Though the reception area 152 is shown to be U-shaped in the figures, it could take on a number of shapes as well, such as V-shaped, J-shaped, etc.

The guiding structures 150 further include the track 154 and a second stop 158. The track 154 can be positioned along an upper portion of the opposing side walls 136. The track 154 can extend from a rear upper portion of the opposing side walls 136 to a front upper portion of the opposing side walls 136. The track 154 can also project inwardly from the inner sides of the opposing side walls 136. The track 154 can include a rounded guide with a first stop 156. The first stop 156 can define a substantially rounded, U-shaped portion of the track 154, such that the pins 128 of the first bin 121 and the second bin 122 can be releasably held. The first stop 156 can prevent the pins 128 from being inadvertently removed from the track 154, and can indicate to a user that the pins 128 have reached their rearmost position. The second stop 158 can include a second, separate track from the track 154. The second stop 158 can be positioned at an upper front corner of the opposing side walls 136. The second stop 158 can be positioned slightly below the track 154. The second stop 158 can be a U-shaped structure that allows the pins 128 of the first bin 121 and the second bin 122 to engage the second stop. The pins 128 can rest on the second stop and be held in the U-shape such that the first bin 121 and the second bin 122 can rest in a pulled out position.

To accommodate the divider 180, the slide unit 130 can include receiving structures for receiving the divider 180. The receiving structures can be positioned on interior portions of the bottom wall 138, rear wall 134, and top wall 140 (not shown) of the slide unit. Specifically, the receiving structures can include slide tracks 198 and gripping structures 199. The receiving structures can be positioned at a midpoint of the slide unit 130, such that the receiving structures can define two separate interior portions of the slide unit 130.

The receiving structures can include the slide tracks 198. The slide tracks 198 are positioned within the inner portion 132 on interior portions of the bottom wall 138 and the top wall 140 of the slide unit 130. The slide tracks 198 can each include a pair of elongated, spaced apart protrusions that define a gap extending axially along the center of the protrusions. A top portion of the protrusions can extend inwardly towards the gap. As such, the guiding projections 191 of the divider 180 can be inserted into the gap and slid along the gap while being held in place by the slide tracks 198. The slide tracks 198 are positioned at approximately the midpoint of the slide unit 130 at interior portions of both the bottom wall 138 and the top wall 140. It is to be understood, however, that the structure of the slide tracks 198 is not limited to the shown example or description herein. For instance, the slide tracks 198 could be longer or shorter in length. Similarly, the slide tracks 198 could take on a number of different shapes that accomplish the same purpose.

The receiving structures can further include the gripping structures 199. As with the slide tracks 198, the gripping structures 199 can be positioned at approximately the midpoint of the slide unit 130. The gripping structures 199 can be positioned on the rear wall 134 of the slide unit 130. In the shown example, there are two gripping structures, however, it is to be understood, that as few as one gripping structure or more than two gripping structures could be provided. The gripping structures 199 each include two outwardly projecting protrusions that define a gap extending therebetween. The gap can define a space where the detent portions 190 of the divider 180 can be inserted. In one example, the gripping structures 199 on the rear wall 134 can include a snap fit means, or the like, configured to releasably engage the detent portions 190 of the divider 180.

In operation, the divider 180 can slide between the slide tracks 198 on the bottom and top walls of the slide unit 130. Specifically, the guiding projections 191 can slide into engagement with the slide tracks 198 on the bottom and top walls. When the divider 180 is completely slid into the slide unit 130, the detent portions 190 of the divider 180 can engage the slide tracks 198 on the rear wall 134 and be snapped into place. Once in place, the divider 180 is prevented from sliding out of position or from being inadvertently removed.

The operation of the storage structure 120 including the first bin 121 and the second bin 122 can now be described. The slide unit 130 can be attached to the receiving structures 18 in the refrigerator 10 in the same manner as previously described. The slide unit 130 can be lowered from above the receiving structures 18 such that the projections 146 in the slide unit 130 can slide behind the receiving structures 18, thus holding the slide unit 130 in place. Once the slide unit 130 is held in place, the divider 180 can be inserted into the inner portion 132 of the slide unit 130. As stated above, the detent portions 190 and the guiding projections of the divider 180 can engage the gripping structures 199 and the slide tracks 198 of the divider 180.

With the slide unit 130 attached to the refrigerator 10 and the divider 180 attached to the slide unit 130, the first bin 121 and the second bin 122 can be inserted into the inner portion 132 of the slide unit 130. As stated above, each of the first bin 121 and the second bin 122 can include two pivoting members 127, one on each opposing side wall. The pivoting members 127 on the outer side walls can be inserted into the reception areas 152 of the slide unit 130, such that the pivoting members 127 are pivotably held in place in the reception areas 152. The pivoting members 127 on the inner side walls can be inserted into the reception areas 188 of the divider 180. Additionally, each of the first bin 121 and the second bin 122 can include two pins 128, one on each opposing side wall. The pins 128 on the outer side walls can be inserted into the second stop 158 and guided along the track 154 of the slide unit 130. Similarly, the pins 128 on the inner side walls of the first bin 121 and the second bin 122 can be inserted into the second stop 186 and guided along the track 182 of the divider 180. The pins 128 can slide along the track 154, 182 with the pins 128 being guided by, but slightly below, the track 154, 182. As the pins 128 are guided along the track, the first bin 121 and the second bin 122 pivot towards the interior of the slide unit 130 about an axis coaxial with the pivoting members 127. Finally, the pins 128 can reach the end of the track whereupon the pins 128 engage the first stop 156, 184 and are held in place. Once in place, the first bin 121 and the second bin 122 are in a first position, shown to be a closed position.

The opening and closing of the first bin 121 and the second bin 122 is substantially identical to the opening and closing of the bin 22 described above with respect to FIGS. 3-5. To open one or both of the first bin 121 and the second bin 122, the user can grasp the handle 125 and pull the bin. As the user pulls the handle 125, the first bin 121 and/or the second bin 122 can pivot outwardly towards the user and out of the inner portion 132 of the slide unit 130. During the opening, the pivoting members 127 can remain in pivoting engagement with the reception areas 152, 188 as the pins 128 are guided along the track 154, 182. The pins 128 can first pass over the first stop 156, 184, then continue along the track 154, 182, before engaging the second stop 158, 186. Upon engaging the second stop 158, 186, the user can release the handle, thus allowing either or both the first bin 121 and the second bin 122 to rest in an opened position. From this position, the user can lift the bin such that the pivoting members 127 and the pins 128 are lifted out of the reception areas 152, 188 and the second stops 158, 186, respectively. Once removed, the first bin 121 and/or the second bin 122 can be taken from the slide unit 130. In one example, the user can run water or liquid over the contents of the bins, such that the water or liquid can freely drain from the bottom wall through the openings 126.

Figure 7:
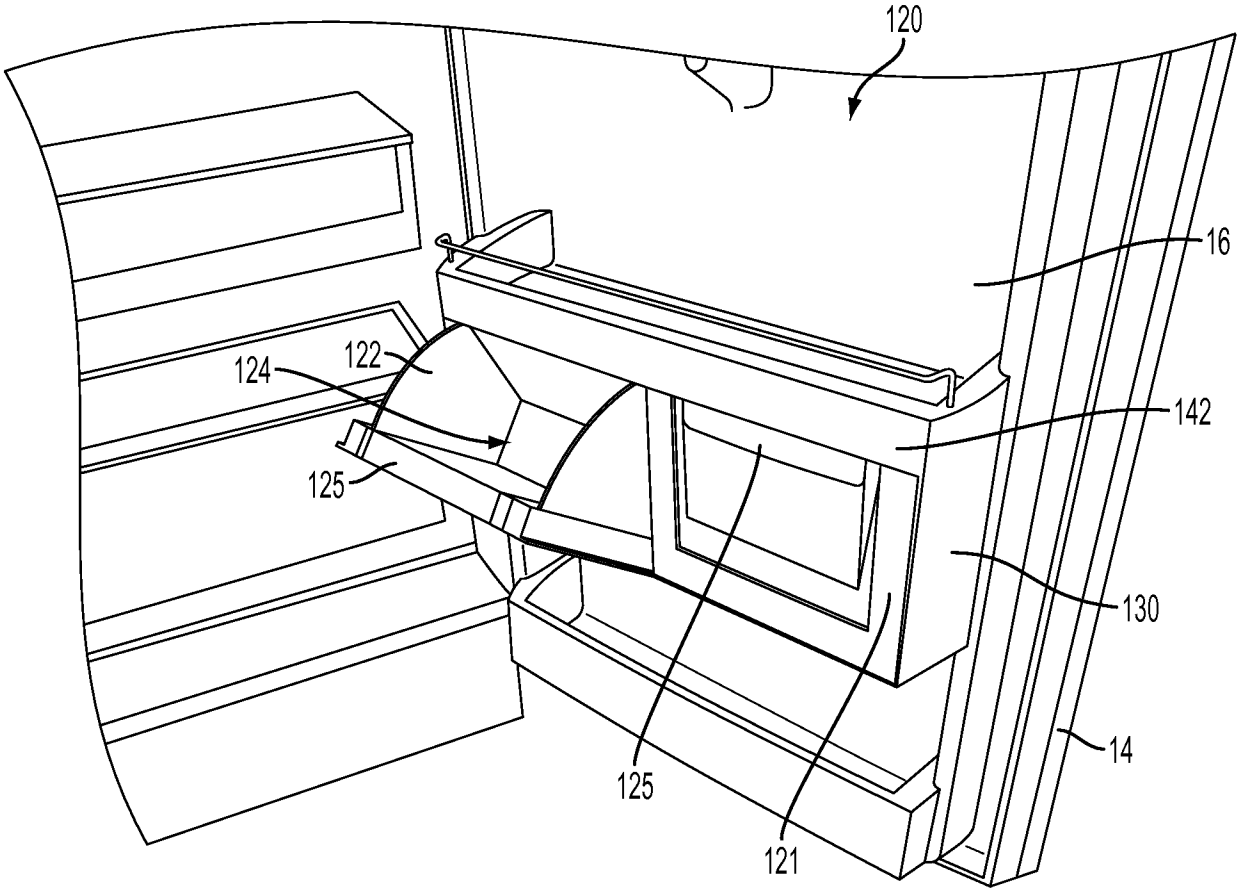
FIG. 7 is a perspective view of the second example storage structure including a first bin in a closed position and a second bin in an opened position.

Referring now to FIG. 7, the storage structure 120 is shown in an installed position on the interior portion 16 of the door 14. In this example, the second bin 122 is in an opened position with the opening 124 exposed to the user. The user can access the contents (not shown) of the opening 124 in this opened position. Further, the user can pivot the second bin 122 to the closed position, or can remove the second bin 122 entirely from the slide unit 130. Additionally, the first bin 121 is shown in the closed position with the opening 124 completely covered by the slide unit 130.

As stated above, the storage structure can further include one or more dividers to allow for more than one harvest bins to be inserted into the slide unit. In this example, the divider can be positioned substantially at the center of the slide unit. The width of a harvest bin can be sized to substantially match the width from the divider to an opposing side wall. The multiple harvest bins can be inserted and removed from the slide unit in substantially the same manner as described above with respect to a single harvest bin.

Figure 8:
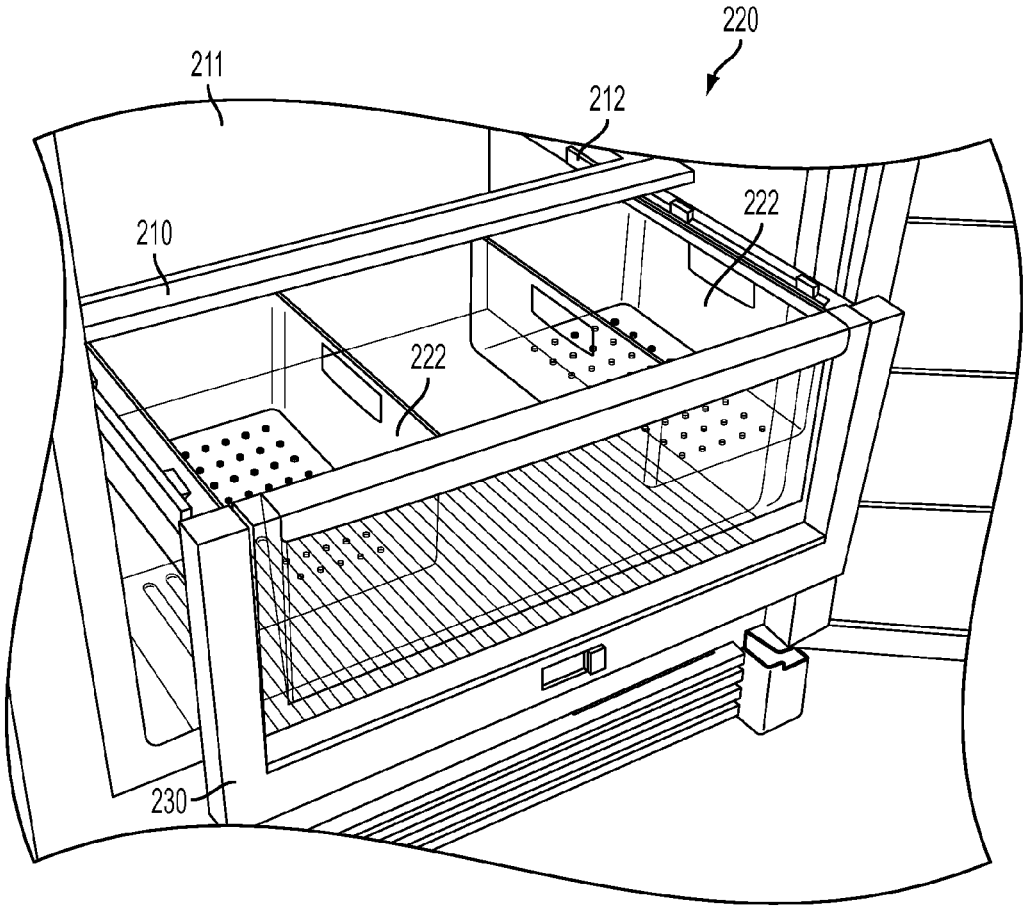
FIG. 8 is a perspective view of a third example storage structure in an opened position.

Referring now to FIG. 8, a third example of a storage structure 220 is shown. The storage structure 220 can be positioned at a variety of locations within the interior compartment 12 of the refrigerator 10. The storage structure 220 can include one or more bins 222 and a slide unit 230. As will be described below, the bins 222 can be removably inserted into the slide unit 230.

The storage structure 220 can include a receiving unit 210 that receives the slide unit 230. The receiving unit 210 can be positioned at a variety of locations within the interior compartment 12 of the refrigerator 10, and is shown to be positioned at a lower portion of the interior compartment 12. The receiving unit 210 can define a cavity into which the slide unit 230 can be inserted. The receiving unit 210 can include a shelf 211 positioned at an upper portion of the cavity upon which items can be placed. The shelf 211 can define an upper wall of the receiving unit 210 that covers the slide unit 230. The slide unit 230 can include receiving structures 212 positioned at opposing sides of the receiving unit 210. The receiving structures 212 can include a variety of structures that allow the slide unit 230 to be removably inserted into the receiving unit 210. For instance, the receiving structures 212 could include rails, recesses, or the like, that receive corresponding structures from the slide unit 230. In further examples, the receiving unit 210 could include other structures, such as slide rails, or the like, that function to removably attach the slide unit 230 to the receiving unit 210.

Figure 9:
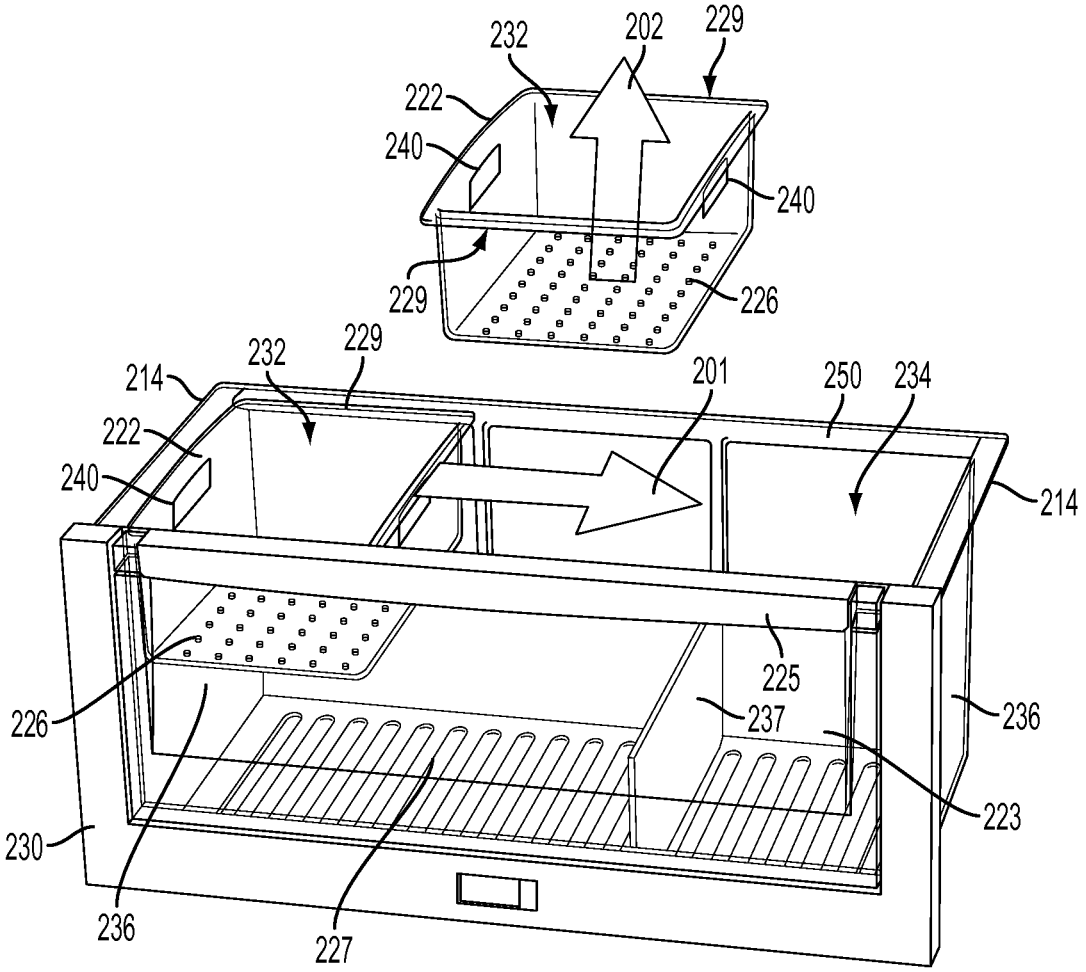
FIG. 9 is a perspective view of the third example storage structure of FIG. 8 including a first bin within a slide unit and a second bin in a removed position.

Referring now to FIG. 9, the storage structure 220 can further include the slide unit 230. The slide unit 230 can define an inner portion 234 into which a user can place items, such as food and drink. The inner portion 234 can be bounded by a bottom wall, and four vertical walls. The vertical walls include opposing side walls 236. Further, the slide unit 230 could include a window 223 positioned at a front wall. The window 223 can allow a user to view objects in the inner portion 234 of the slide unit 230. A handle 225 could be provided on the front wall, allowing the slide unit 230 to be removably inserted into the receiving unit 210. The inner portion 234 can further include an opening at the top, such that the items can be placed in the slide unit 230 through the opening. The opposing side walls 236 can include projections 214 that project outwardly from the opposing side walls 236. The projections 214 are shown to project from a top portion of the opposing side walls 236, however, other locations are envisioned. The slide unit 230 can include a guiding structure 250 positioned along the walls. The guiding structure 250 can include a horizontal or substantially horizontal surface positioned near a top portion of the walls of the slide unit 230. The guiding structure 250 could extend partially or completely around the top portion of the walls and around the inner portion 234.

The slide unit 230 can further include a variety of structures to allow water or liquid to drain from the slide unit 230. For instance, the bottom wall can include one or more openings 227, apertures, holes, etc. The openings 227 could be positioned at a plurality of locations within the slide unit 230, such as along the edges of the bottom wall, towards the center of the bottom wall, on some or all of the side walls, etc. Similarly, the openings 227 are shown to be linear, elongated openings, however other structures are contemplated. For instance, the openings 227 could include one or more holes.

The slide unit 230 can be removably inserted into the receiving unit 210. Specifically, the projections 214 of the slide unit 230 can removably attach the slide unit 230 to the receiving unit 210. The projections 214 can engage the receiving structures 212 of the receiving unit 210. As stated above, the receiving structures 212 could include a recess, or the like, such that the recess could be sized to receive the projections 214. Accordingly, the slide unit 230 can slide into the receiving unit 210 into a closed position (as shown in FIG. 1). Further, the slide unit 230 can slide out of the receiving unit 210 into an opened position (as shown in FIG. 8). In further examples, the slide unit 230 could be removed from the receiving unit 210. As such, when the slide unit 230 is removed, the slide unit can be taken to a sink, faucet, or the like. Water can wash over the items in the slide unit 230 and drain through the openings 227. When finished, the slide unit 230 can be replaced in the receiving unit 210.

The slide unit 230 can further hold one or more bins 222. The bins 222 can be removably inserted in the inner portion 234 of the slide unit 230. The bins 222 can each define an inner portion 232 surrounded by four vertical walls and a bottom wall. The inner portion 232 is sized to receive items, such as fruits, vegetables, drinks, or the like. The bottom wall can include one or more openings 226 that allow water or liquid to drain from the bin 222. The openings 226 can be positioned at a plurality of locations within the bin 222, such as along the edges of the bottom wall, towards the center of the bottom wall, on some or all of the side walls, etc. The openings 226 can include a number of structures, and are not limited to the apertures in the shown example. For instance, the openings could further include elongated openings, similar to those shown in the slide unit 230. The bins 222 can further include one or more handles 240. The handles 240 are shown as cut-out portions, and can include a variety of shapes and sizes. The handles 240 can be positioned on opposing walls of the bins 222.

The bins 222 can include an engagement structure 229 that attaches the bins 222 to the slide unit 230. The engagement structure 229 can project laterally outwardly from a top portion of the bins 222. The engagement structure 229 could include a variety of structures, such as a ledge, outcropping, or the like. The engagement structure 229 can surround each of the bins 222 on all four sides or, in the alternative, could surround each of the bins 222 on two opposing sides. The engagement structure 229 can project a predetermined distance, such as 1 inch, ½ inch, etc. The engagement structure 229 can engage the guiding structures 250 of the slide unit 230. Specifically, the engagement structures 229 can rest on the guiding structures 250, such that the guiding structures 250 support the engagement structures 229 and, thus, the bins 222. It is to be understood that a variety of structures could be used for attaching the bins 222 to the slide unit 230, and the attachment is not limited to the structure described herein. For instance, the bins 222 may not include an engagement structure 229 and, instead, could be sized to be slightly larger than a width of the slide unit 230. As such, the bins 222 could rest on the guiding structures 250 without the use of projections, ledges, etc. Similarly, the bins 222 could include a snap fit means, or the like, that removably attaches the bins 222 to the guiding structures 250.

Figure 10:
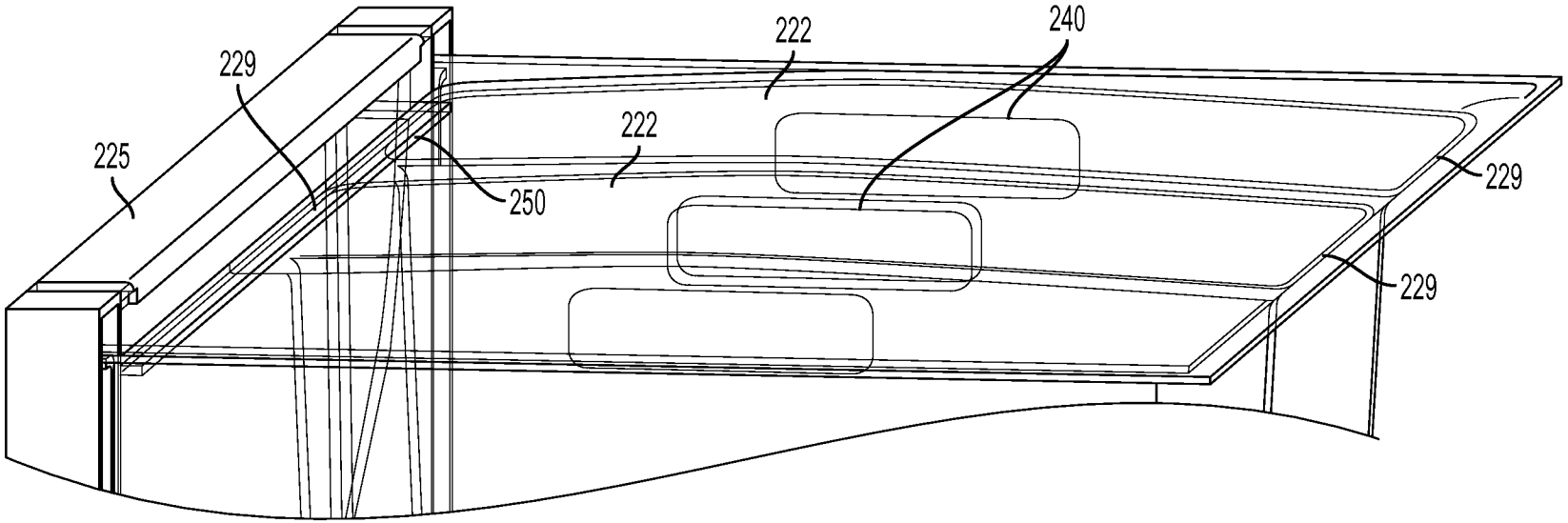
FIG. 10 is a side view of the third example storage structure in an opened position.

Referring now to FIG. 10, the bins 222 are shown attached to and supported by the slide unit 230. Specifically, each of the bins 222 can include the engagement structures 229 at a front portion adjacent the handle 225 and at a rear portion away from the handle 225. The engagement structure 229 is shown to be mounted on the guiding structure 250 positioned at a rear portion of the front wall of the slide unit 230.

The operation of the storage structure 220, including the slide unit 230 and bins 222 can now be described. The slide unit 230 can be removed from the receiving unit 210. A user can grip the handle 225 of the slide unit 230 and pull, causing the slide unit 230 to translate out of the receiving unit 210. Once the slide unit 230 is withdrawn into an opened position (shown in FIG. 8), the bins 222 of the slide unit 230 will be exposed. The bins 222 can rest in a first position (shown in FIG. 8), wherein the bins 222 rest within the slide unit 230. The bins 222 can store items, such as food, drink, or the like. The bins 222 can define an upper storage section within the slide unit 230, while a bottom wall of the slide unit 230 defines a separate, lower storage section. The engagement structures 229 of the bins 222 can engage the guiding structure 250, allowing the bins 222 to move with respect to the slide unit 230. For instance, the bins 222 can move in a horizontal direction 201 along the slide unit 230. The bins 222 could slide from a side of the slide unit 230 towards the center of the slide unit 230 (as shown in FIG. 9). Similarly, the bins 222 can be lifted out of the slide unit 230 in a vertical direction 202. Once lifted out, the bins 222 are in a removed position and can be brought to a sink and rinsed with water. Water can run over the items within the bin, and can empty from the bin through the openings 226. The user can eventually replace the bins 222 within the slide unit 230, and move the slide unit 230 to a closed position within the receiving unit 210. In the alternative, the user may choose not to replace the bins 222 within the slide unit 230 and/or may only replace one bin 222 within the slide unit 230. In such an example, the slide unit 230 can still be closed with one or zero bins.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A refrigerator including:

a refrigerator compartment;

a storage structure positioned within the refrigerator compartment, the storage structure including:

a slide unit attached within the refrigerator compartment; and at least one bin removably attached to the slide unit, the at least one bin movable between an opened position and a closed position, wherein the slide unit includes guiding structures positioned within an inner portion of the slide unit, wherein the guiding structures include a reception area and a curved track, wherein the at least one bin includes a pivoting member and a pin, wherein the pivoting member is configured to engage the reception area and pivot with respect to the reception area, wherein the pin is configured to engage the curved track and slide with respect to the curved track, and wherein the reception area includes an open portion through which the pivoting member is configured to pass in a first direction to engage the reception area and through which the pivoting member is configured to pass in a second direction to permit removal of the at least one bin from the slide unit, and wherein the guiding structures include a stop and wherein the stop comprises a separate structure from the curved track, and wherein the separate structure is spaced apart from the curved track to form a gap between which the pin is configured to pass in a third direction to engage the curved track and between which the pin is configured to pass in a fourth direction to permit removal of the at least one bin from the slide unit.

2. The refrigerator according to claim 1, wherein the first direction and the third direction are parallel.

3. The refrigerator according to claim 1, wherein the second direction and the fourth direction are parallel.

4. The refrigerator of claim 1, wherein the first direction, the second direction, the third direction, and the fourth direction are parallel.

5. The refrigerator of claim 1, wherein the pivoting member is arranged at a front portion of the at least one bin and the pin is arranged at a rear portion of the at least one bin.

6. The refrigerator of claim 5, wherein the pivoting member and the pin are vertically aligned when the at least one bin is in the opened position.

7. A refrigerator including:

a refrigerator compartment;

a storage structure comprising a receiving unit positioned within the refrigerator compartment, the receiving unit being configured to translate along a first level plane in and out of the refrigerator compartment relative to the storage structure, the storage structure including:

a slide unit removably attached to the receiving unit within the refrigerator compartment, the slide unit including one or more projections extending outwardly from the slide unit for engaging receiving structures of the receiving unit within the refrigerator compartment, the one or more projections configured to translate with the receiving unit relative to the receiving structures and slide along the receiving structures when the receiving unit is translated in and out of the storage compartment; and at least one bin removably attached to the slide unit, the at least one bin including an engagement structure configured to movably attach the bin to the slide unit, wherein the at least one bin is configured to translate relative to the slide unit across an opening of the refrigerator compartment along a second level plane parallel to the first level plane in a direction perpendicular to the in and out sliding motion of the receiving unit.

8. The refrigerator according to claim 7, wherein the projections are configured to contact the receiving structures when the slide unit is attached to the receiving unit within the refrigerator compartment.

9. The refrigerator according to claim 8, wherein the slide unit includes a recessed portion that projects inwardly from opposing side walls of the slide unit, the recessed portion including a size that is substantially equal to a width that extends between the receiving structures.

10. The refrigerator according to claim 7, wherein the at least one bin includes an engagement structure for movably attaching the at least one bin to a guiding structure of the slide unit, wherein the engagement structure is configured to slide with respect to the guiding structure, and wherein the engagement structure projects laterally outwardly in a direction away from the at least one bin.

11. The refrigerator according to claim 10, wherein the guiding structure of the slide unit comprises a front portion of the slide unit and a rear portion of the slide unit, the engagement structure of the at least one bin contacts the front portion of the slide unit and the rear portion of the slide unit and the at least one bin spans between the front portion of the slide unit and the rear portion of the slide unit, and wherein the front portion of the slide unit and the rear portion of the slide unit define at least a portion of an upper periphery of the slide unit.

12. A storage structure for mounting within a refrigerator, the storage structure including:

a slide unit attached within the refrigerator, the slide unit including one or more guiding structures projecting outwardly from a wall of the slide unit; and at least one bin movably mounted to the slide unit, the at least one bin including engagement structures configured to engage the guiding structures, wherein the engagement structures are configured to move with respect to the guiding structures, further wherein the at least one bin is removable from the slide unit, wherein the guiding structures include a track and a stop, wherein the stop comprises a separate structure from the track, and wherein the separate structure is spaced apart from the track to form a gap between which at least one of the engagement structures is configured to pass in a first direction to engage the track and between which the at least one of the engagement structures is configured to pass in a second direction to permit removal of the at least one bin from the slide unit.

13. The storage structure according to claim 12, wherein the at least one bin includes one or more openings configured to allow liquid to drain through the one or more openings.

14. The storage structure of claim 12, wherein the engagement structures include one or more pins projecting outwardly from the at least one bin, the pins being configured to nest within the stop when the at least one bin is in an opened position.

15. The storage structure according to claim 12, wherein the guiding structures of the slide unit include a reception area, and wherein the engagement structures of the at least one bin include a pivoting member, and wherein the pivoting member is configured to engage the reception area and pivot with respect to the reception area.

16. The storage structure according to claim 15, wherein the reception area includes an open portion through which the pivoting member is configured to pass in a third direction to engage the reception area and through which the pivoting member is configured to pass in a fourth direction to permit removal of the at least one bin from the slide unit.

17. A refrigerator including:

a refrigerator compartment;

a storage structure positioned within the refrigerator compartment, the storage structure including:

a slide unit attached within the refrigerator compartment; and at least one bin removably attached to the slide unit, the at least one bin movable between an opened position and a closed position, wherein the at least one bin includes a first bin and a second bin, wherein the storage structure further includes a divider removably inserted into the slide unit, the divider being positioned between the first bin and the second bin within the slide unit, and wherein the divider includes a reception area and a curved track.

18. The refrigerator according to claim 17, wherein the first bin and the second bin are each configured to engage the reception area and the curved track of the divider.

19. The refrigerator according to claim 18, wherein the first bin and the second bin are each configured to pivot with respect to the slide unit between an opened and a closed position.

* * * * *